US009227405B2

(12) United States Patent
Satake

(10) Patent No.: US 9,227,405 B2
(45) Date of Patent: Jan. 5, 2016

(54) INKJET RECORDING APPARATUS

(75) Inventor: Kenichi Satake, Osaka (JP)

(73) Assignee: KYOCERA DOCUMENT SOLUTIONS INC., Osaka-shi (JP)

( * ) Notice: Subject to any disclaimer, the term of this patent is extended or adjusted under 35 U.S.C. 154(b) by 181 days.

(21) Appl. No.: 13/559,374

(22) Filed: Jul. 26, 2012

(65) Prior Publication Data

US 2013/0027493 A1 Jan. 31, 2013

(30) Foreign Application Priority Data

Jul. 28, 2011 (JP) ..... 2011-165048

(51) Int. Cl.

| | |
|---|---|
| ***B41J 2/01*** | (2006.01) |
| ***B41J 29/38*** | (2006.01) |
| ***B41J 2/165*** | (2006.01) |
| ***B41J 2/155*** | (2006.01) |

(Continued)

(52) U.S. Cl.

CPC ..... *B41J 2/155* (2013.01); *B41J 11/007* (2013.01); *B41J 11/0085* (2013.01); *B41J 11/06* (2013.01); *B41J 2/16523* (2013.01); *B41J 2/16532* (2013.01)

(58) Field of Classification Search

CPC ..... B41J 2/155; B41J 11/06; B41J 11/0085; B41J 11/007; B41J 13/08; B41J 2/16505; B41J 2/165; B41J 29/377; B41J 2002/14169; B41J 2202/20; B65H 5/02

USPC ..... 347/104, 12, 29–30, 32–33, 40–41, 85, 347/92, 101

See application file for complete search history.

(56) References Cited

U.S. PATENT DOCUMENTS

| | | | | |
|---|---|---|---|---|
| 5,917,525 | A * | 6/1999 | Butty | 347/86 |
| 6,523,946 | B2 * | 2/2003 | Mou et al. | 347/86 |
| 6,540,322 | B2 * | 4/2003 | Usui et al. | 347/29 |

(Continued)

FOREIGN PATENT DOCUMENTS

| | | | |
|---|---|---|---|
| JP | 2006-240185 | A | 9/2006 |
| JP | 2008-87446 | A | 4/2008 |

(Continued)

OTHER PUBLICATIONS

Machine Translation of JP2006-240185.

(Continued)

*Primary Examiner* — Julian Huffman
*Assistant Examiner* — Leonard S Liang
(74) *Attorney, Agent, or Firm* — Knobbe Martens Olson & Bear LLP

(57) ABSTRACT

An inkjet recording apparatus may include a conveyor belt, suction unit, linear recording heads, and head frame shaped like a plate. The conveyor belt has a placement face on which a recording medium is placed and may be configured to cause the placement face to move in a conveyance direction. The suction unit disposed below the placement face applies a suction force exerted by a downward airflow to the recording medium placed on the placement face. The linear recording heads may be disposed upward opposite to the suction unit across the conveyor belt, have a nozzle face where an ink ejection nozzle is formed, and extend in a direction orthogonal to the conveyance direction. Linear recording heads may be arranged in the conveyance direction. The linear recording heads may be attached to the head frame. The head frame may have a ventilation opening penetrating in a thickness direction.

7 Claims, 12 Drawing Sheets

(51) Int. Cl.
*B41J 11/00* (2006.01)
*B41J 11/06* (2006.01)

(56) References Cited

U.S. PATENT DOCUMENTS

| | | | | |
|---|---|---|---|---|
| 7,083,274 | B2 * | 8/2006 | Morita et al. | 347/104 |
| 7,178,915 | B2 * | 2/2007 | Nakashima et al. | 347/104 |
| 7,824,007 | B2 * | 11/2010 | Chikamoto et al. | 347/33 |
| 8,002,388 | B2 * | 8/2011 | Nishino | 347/49 |
| 8,025,368 | B2 * | 9/2011 | Watanabe | 347/68 |
| 8,182,081 | B2 * | 5/2012 | Yamamoto et al. | 347/104 |
| 8,192,006 | B2 * | 6/2012 | Koseki | 347/92 |
| 2002/0008728 | A1 * | 1/2002 | Usui et al. | 347/29 |
| 2002/0105567 | A1 * | 8/2002 | Yamada et al. | 347/87 |
| 2005/0068365 | A1 * | 3/2005 | Takagi | 347/33 |
| 2005/0078144 | A1 * | 4/2005 | Yamada et al. | 347/30 |
| 2005/0122372 | A1 * | 6/2005 | Shimizu | 347/22 |
| 2005/0162452 | A1 * | 7/2005 | Kachi | 347/13 |
| 2005/0206678 | A1 * | 9/2005 | Nishino | 347/43 |
| 2007/0035605 | A1 * | 2/2007 | Kitahara | 347/104 |
| 2007/0126832 | A1 * | 6/2007 | Kito | 347/101 |
| 2009/0109254 | A1 * | 4/2009 | Satake et al. | 347/16 |
| 2009/0189967 | A1 * | 7/2009 | Sakano | 347/104 |
| 2011/0122192 | A1 * | 5/2011 | Takahashi et al. | 347/33 |
| 2011/0242220 | A1 * | 10/2011 | Yamagishi et al. | 347/47 |
| 2012/0056925 | A1 * | 3/2012 | Yamagishi et al. | 347/14 |
| 2012/0120174 | A1 | 5/2012 | Hosoya et al. | |

FOREIGN PATENT DOCUMENTS

| | | | |
|---|---|---|---|
| JP | 2009-178846 | A | 8/2009 |
| JP | 2009-178848 | A | 8/2009 |
| JP | 2012-106347 | A | 6/2012 |

OTHER PUBLICATIONS

Machine Translation of JP2008-87446.

Notice of Reasons for Rejection issued to JP Application No. 2011-165048 mailed Oct. 15, 2013.

* cited by examiner

INKJET RECORDING APPARATUS

REFERENCE TO RELATED APPLICATIONS

This application is based upon and claims the benefit of priority from the corresponding Japanese Patent Application No. 2011-165048, filed in the Japan Patent Office on 28 Jul. 2011, the entire contents of which are incorporated herein by reference.

BACKGROUND

The present disclosure relates to an inkjet recording apparatus that records information on a recording medium such as paper by ejection of ink from a nozzle.

An inkjet recording apparatus is generally provided with: a conveyor belt that has a placement face on which a recording medium is placed and conveyed, and that causes the placement face to move in a horizontal direction; a suction unit that is disposed below the placement face of the conveyor belt and that applies a suction force by a downward airflow to the recording medium, such that the recording medium is sucked onto the placement face; a plurality of linear recording heads that is disposed upward opposite to the suction unit across the conveyor belt, has a nozzle face on which an ink ejection nozzle is formed, and extends in an orthogonal direction orthogonal to the conveyance direction; and a plate-like head frame to which the plurality of linear recording heads is attached in an array in the conveyance direction.

In the conventional inkjet recording apparatus, the plate-like head frame has a size substantially covering the placement face (face onto which the recording medium is sucked) and is provided with attachment openings through which the plurality of linear recording heads is attached onto the head frame. A plate-like part of the head frame other than the attachment openings is not provided with a vertical through-hole or opening.

SUMMARY

The inkjet recording apparatus may include a conveyor belt, a suction unit, a plurality of linear recording heads, and a head frame shaped like a plate. The conveyor belt having a placement face on which a recording medium is placed and conveyed may be configured to cause the placement face to move in a conveyance direction of conveying the recording medium. The suction unit that is disposed below the placement face of the conveyor belt may be configured to apply a suction force exerted by a downward airflow to the recording medium placed on the placement face, such that the recording medium may be sucked onto the placement face. The linear recording heads may be disposed upward opposite to the suction unit across the conveyor belt, have a nozzle face on which an ink ejection nozzle is formed, and extend in an orthogonal direction orthogonal to the conveyance direction. The plurality of linear recording heads may be arranged in the conveyance direction in a plural manner. The plurality of linear recording heads may be attached to the head frame shaped like a plate. The head frame shaped like a plate may have a ventilation opening penetrating in a thickness direction at a portion shaped like a plate except for where the plurality of linear recording heads is attached.

DETAILED DESCRIPTION

First Embodiment

Figure 1:
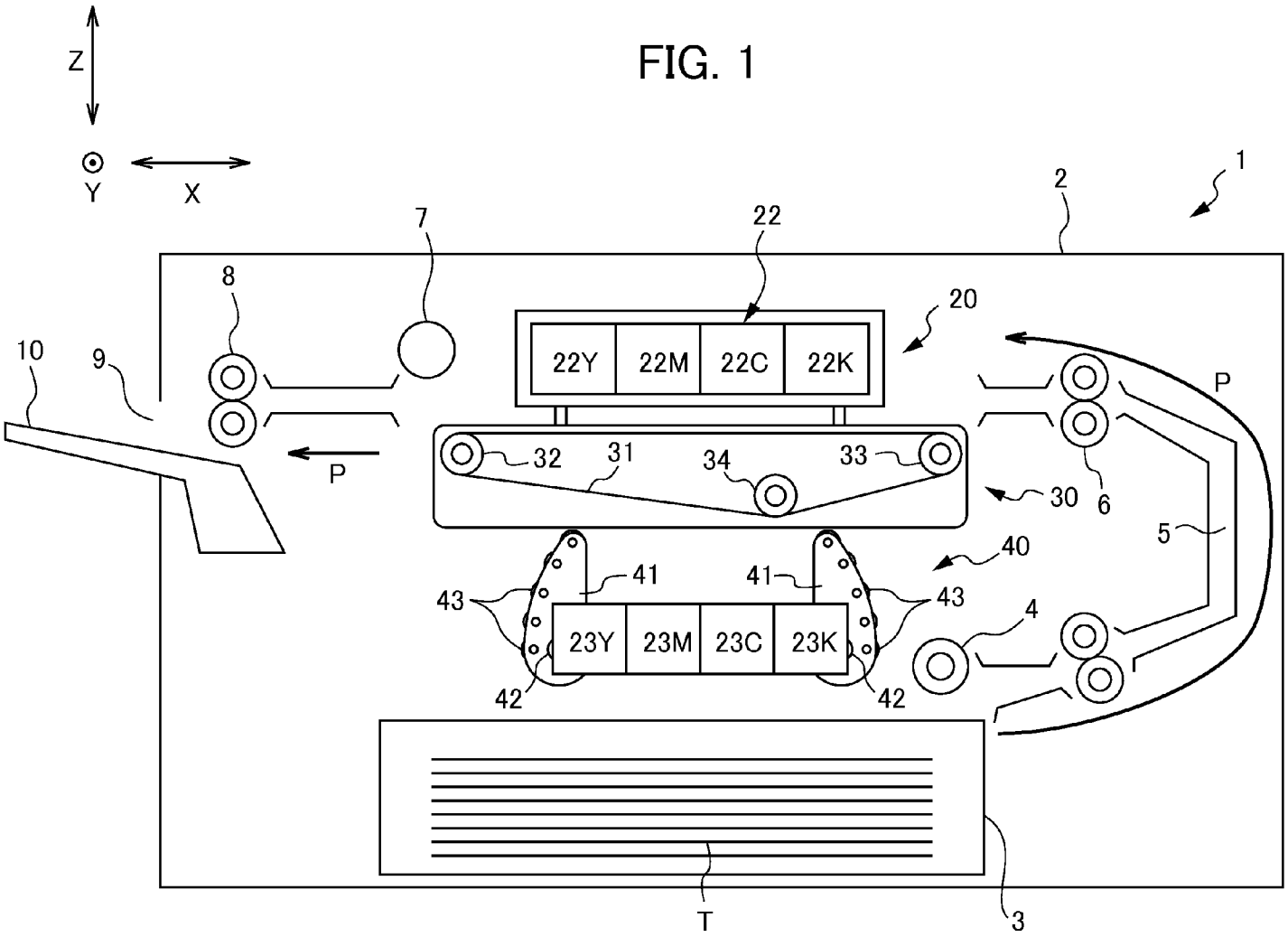
FIG. 1 is a vertical cross-sectional view schematically showing an overview of an inkjet recording apparatus 1 according to a first embodiment of the present disclosure when viewed from a front side.
Figure 2:
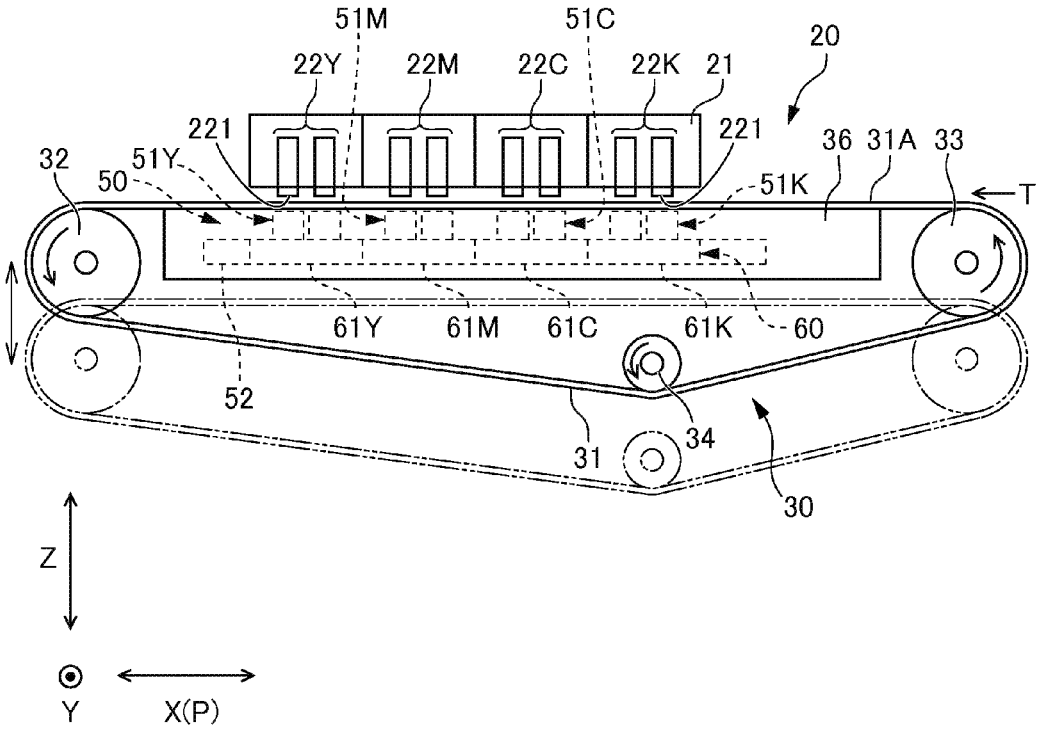
FIG. 2 is a front view illustrating a periphery of a recording unit 20 and a conveyance unit 30 in the inkjet recording apparatus 1 according to the first embodiment.
Figure 3:
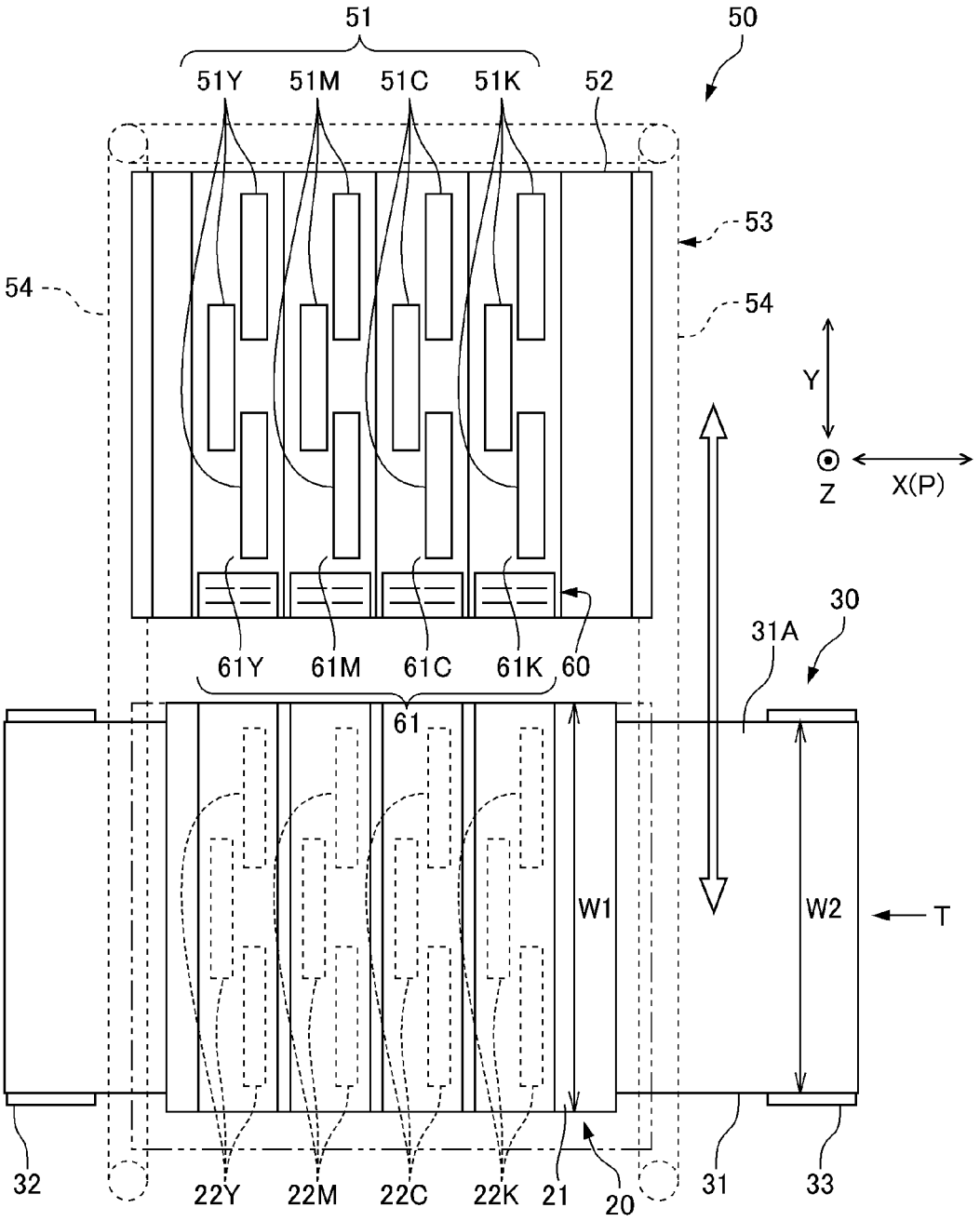
FIG. 3 is a plan view illustrating a periphery of the recording unit 20, the conveyance unit 30, and a cap unit 50 in the inkjet recording apparatus 1 according to the first embodiment.

A first embodiment of the present disclosure is described hereinafter with reference to the drawings. An overview of an overall structure of an inkjet recording apparatus 1 according to the first embodiment of the present disclosure is described with reference to FIGS. 1 to 3. FIG. 1 is a vertical cross-sectional view schematically showing an overview of the inkjet recording apparatus 1 according to the first embodiment of the present disclosure when viewed from a front side. FIG. 2 is a front view illustrating a periphery of a recording unit 20 and a conveyance unit 30 in the inkjet recording apparatus 1 according to the first embodiment. FIG. 3 is a plan view illustrating a periphery of the recording unit 20, the conveyance unit 30, and a cap unit 50 in the inkjet recording apparatus 1 according to the first embodiment.

As shown in FIGS. 1 to 3, the inkjet recording apparatus 1 according to the first embodiment includes the recording unit 20, the conveyance unit 30, a lifting and lowering device 40 for the conveyance unit 30, and the cap unit 50, inside a main body 2.

The inkjet recording apparatus 1 according to the first embodiment further includes a paper feeding cassette 3, a paper feeding roller 4, a paper path 5, a pair of registration rollers 6, a drying device 7, a pair of paper discharging rollers 8, a paper ejection opening 9, and an ejected paper tray 10.

As shown in FIGS. 1 to 3, the conveyance unit 30 has a drive roller 32, a driven roller 33, a conveyor belt 31 that is stretched around the drive roller 32 and the driven roller 33, a tension roller 34 that adjusts tension of the conveyor belt 31, and a suction unit 36. On the conveyor belt 31 and an upper face of the suction unit 36, a large number of through holes (not shown) for suction are provided.

The drive roller 32 and the driven roller 33 rotating in a counterclockwise direction viewed from front cause the placement face 31A composed of an upper face of the conveyor belt 31 to horizontally move from a first side to a second side in a conveyance direction P on a horizontal plane (X-Y plane). In other words, on the placement face 31A of the conveyor belt 31, the conveyance direction P substantially corresponds to a horizontal direction X. The suction unit 36 is disposed below (on an opposite side) the conveyance face 31A of the conveyor belt 31.

It may be possible to employ an endless belt in which end portions are overlapped and joined, a seamless belt, and the like as the conveyor belt 31.

As shown in FIGS. 2 and 3, when recording is performed, a sheet of paper T as a recording medium is introduced from the first side in the conveyance direction P and placed on the placement face 31A of the conveyor belt 31. Operation of the suction unit 36 applies a suction force to the placement face 31A. More specifically, the suction force is a downward suction force applied to the conveyor belt 31, which is generated by a downward airflow via through holes for suction (not illustrated) provided on the upper face of the conveyor belt 31 and the suction unit 36. The sheet of paper T placed on the placement face 31A of the conveyor belt 31 is conveyed toward the second side in the conveyance direction P, while the sheet of paper T is sucked to the conveyance face 31A by the suction force exerted by the downward airflow. A linear recording head 22 of the recording unit 20 (described later) ejects ink toward the sheet of paper T, which is conveyed while being sucked to the placement face 31A by the suction force. In this manner an image and the like are recorded (printed) on the sheet of paper T.

As shown in FIG. 1, the paper feeding cassette 3 stores sheets of paper T in stack and is disposed upstream of the conveyance unit 30 in the conveyance direction P at a lower portion inside the main body 2. The paper feeding roller 4 is disposed above the paper feeding cassette 3. The paper feeding roller 4 feeds a sheet of paper T toward upper right of the paper feeding cassette 3 in FIG. 1.

The paper path 5, the pair of registration rollers 6, the recording unit 20 and the conveyance unit 30 are disposed downstream of the paper feeding cassette 3 in the conveyance direction P. The sheet of paper T fed from the paper feeding cassette 3 passes through the paper path 5 and reaches the pair of registration rollers 6. The pair of registration rollers 6 corrects a skew of the sheet of paper T and feeds out the sheet of paper T again. A sensor to detect a front end of a sheet of paper (not shown) is provided between the recording unit 20 and the pair of registration rollers 6 in the paper path 5. This sensor detects a front end of a sheet of paper T. The recording unit 20 performs ink ejection (described later) based on a signal of timing detected.

As shown in FIG. 1, a dryer 7 is disposed downstream of the conveyance unit 30 in the conveyance direction P at an upper portion inside the main body 2. The dryer 7 dries the ink on the sheet of paper T after the sheet of paper T is recorded with the ink ejected in the recording unit 20.

The pair of paper discharging rollers 8, the paper ejection opening 9, and the ejected paper tray 10 are disposed in this order downstream of the dryer 7 in the paper conveyance direction P. The sheet of paper T completing drying of the ink performed by the dryer 7 is conveyed by the pair of paper discharging rollers 8 downstream in the conveyance direction P. The sheet of paper T is further conveyed to the ejected paper tray 10 provided outside the main body 2 via the paper ejection opening 9, and discharged outside from the main body 2.

As shown in FIGS. 1 to 3, the recording unit 20 is provided with the linear recording head 22 corresponding to four colors and the head frame 21 like a rectangular plate. The linear recording head 22 corresponding to four colors includes a linear recording head 22K for black, linear recording head 22C for cyan, linear recording head 22M for magenta and linear recording head 22Y for yellow. The linear recording heads 22K, 22C, 22M and 22Y of the four colors each extend in a paper width direction (orthogonal direction) Y that is orthogonal to the conveyance direction P (the horizontal direction X).

In the first embodiment, each of the linear recording heads 22K, 22C, 22M and 22Y has three recording heads per color arranged in a staggered manner in the paper width direction Y. The "linear recording head" may also be simply referred to as "recording head" when discrimination therebetween is not particularly necessary.

The linear recording heads 22K, 22C, 22M and 22Y of four colors are disposed in this order along the conveyance direction P of the conveyor belt 31, from upstream to downstream in the conveyance direction P. The linear recording heads 22K, 22C, 22M and 22Y of four colors are arranged in this order and attached to the head frame 21. A configuration of the head frame 21 will be described later in detail.

As shown in FIG. 1, four ink tanks 23K, 23C, 23M and 23Y corresponding to the linear recording heads 22K, 22C, 22M and 22Y of the four colors are disposed below the conveyance unit 30. Inks of four colors are supplied from the four ink tanks 23K, 23C, 23M and 23Y to the corresponding linear recording heads 22K, 22C, 22M and 22Y respectively, via a feeding tube (not shown).

It should be noted that, in the following description, reference symbols K, C, M and Y in the recording heads 22K, 22C, 22M and 22Y of the four colors and the four ink tanks 23K, 23C, 23M and 23Y are omitted unless required for description of configuration of characterizing parts (described later), and the recording heads and the ink tanks are simply referred to as "a (linear) recording head 22" and "an ink tank 23". The same applies to a "cap 51" and a "cap lower part support 61" (described later).

The linear recording heads 22 in the recording unit 20 respectively eject inks of four colors toward a sheet of paper T, which is placed on the placement face 31A of the conveyor belt 31, based on the information related to image data (such as a character, diagram and pattern) received from an external computer (not illustrated). Each of the linear recording heads 22 is fixed to the main body 2 along with the head frame 21. The inks of four colors are sequentially ejected from the linear recording heads 22 at predetermined timing, following rotational movement of the conveyor belt 31. As a result, the inks of black, cyan, magenta and yellow are overlapped on the sheet of paper T, so that an image of color inks is printed on the sheet of paper T.

It may be possible to adopt various methods as a method of ejecting inks from recording head 22. Examples include a piezoelectric method, in which ink is ejected by a piezoelectric element (not shown), and a thermal inkjet method, in which air bubbles are generated by a heating element (not shown) to apply pressure to cause ink to be ejected.

As shown in FIG. 1, the lifting and lowering device 40 of the conveyance unit 30 is disposed below the conveyance unit 30. The lifting and lowering device 40 causes the conveyance unit 30 to be lifted and lowered (moved) with respect to the recording head 22 in a direction Z (hereinafter also referred to as "a vertical direction Z") that is vertical to the horizontal plane (X-Y plane). Movement of the conveyance unit 30 in the vertical direction Z performed by the lifting and lowering device 40 causes the conveyance face 31A of the conveyor belt 31 to be relatively movable toward and away from a nozzle face 221 (see FIG. 2) of the recording head 22.

As shown in FIG. 1, the lifting and lowering device 40 is provided with two eccentric cams 41 that are disposed upstream and downstream in the conveyance direction P below the conveyor belt 31. Two eccentric cams 41 are disposed on each of the front and back sides of the conveyance unit 30, namely, four eccentric cams in total. An eccentric peripheral surface of each eccentric cam 41 approaches an outer bottom face of the conveyance unit 30 from a lower side. As shown in FIG. 1, each eccentric cam 41 has an axis 42 extending in the paper width direction Y, a rotational axis line of which is eccentrically located. Each eccentric cam 41 is rotated about the axis 42 driven by a motor (not shown). Each eccentric cam 41 includes a plurality of bearings 43 at a peripheral portion thereof. A portion of a peripheral surface of each bearing 43 projects outward from a peripheral surface of each eccentric cam 41.

Each bearing 43 is configured to be rotatable about an axis line parallel to the rotational axis line of an eccentric cam 41. The bearings 43 are disposed sequentially from a distal end to a rotational axis line of the eccentric cam 41. In a normal printing state, a bearing 43 that lies most away from an axis 42 comes in contact with the outer bottom face of the conveyance unit 30 from a lower side, as shown in FIG. 1. Accordingly, the conveyance unit 30 moves upward to the highest position shown in FIG. 2.

From this position, the eccentric cam 41 located upstream in the conveyance direction P is rotated in a counterclockwise direction when viewed from front and the eccentric cam 41 located downstream in the conveyance direction P is rotated in a clockwise direction when viewed from front. Accordingly, the plurality of bearings 43 sequentially come in contact with the outer bottom face of the conveyance unit 30 in order, from a bearing 43 located most away from the axis 42 to a bearing 43 located closest to the axis 42. In this manner, it is possible to lower the conveyance unit 30.

The plurality of bearings 43 is disposed at such intervals that there is a time period where two bearings 43 adjacent to each other in a peripheral direction are simultaneously in contact with the outer bottom face of the conveyance unit 30 while the eccentric cam 41 rotates.

When the conveyance unit 30 is lowered by rotation of the eccentric cam 41 of the lifting and lowering device 40, the conveyance face 31A of the conveyor belt 31 in the conveyance unit 30 is moved downward away from the recording head 22, as shown by virtual lines in FIG. 2. Accordingly, the cap unit 50 is separated from the recording head 22. While the cap unit 50 is separated from the recording head 22, an inkjet nozzle (not shown) of the recording head 22 is compelled to discharge ink. In this manner, it is possible to discharge high viscosity ink remaining in the nozzle to perform the recovery processing by discharging (purge) for eliminating ink clogging.

On the other hand, when the conveyance unit 30 is lifted by rotation of the eccentric cam 41 of the lifting and lowering device 40 in a direction opposite to the abovementioned direction, the conveyance unit 30 is restored to a normal recording position (printing position) as shown in FIG. 2. As a result of the operation described above, it is possible to attach the cap unit 50 to the nozzle face 221 of the recording head 22.

As shown in FIGS. 2 and 3, the cap unit 50 is arranged beside and below the recording unit 20 (outside the region of paper conveyance) during image formation. The cap unit 50 is movable to be below the recording unit 20 as necessary. The cap unit 50 is provided with a cap 51 as a second ink receiving member, a cap lower part support 61 as a first ink receiving member; a cap base member 52; a sliding mechanism 53; and a vertical driving mechanism (not illustrated). The cap unit 50 is configured to be movable horizontally in the paper width direction Y by the sliding mechanism 53 (see FIG. 3). It should be noted that illustration of the sliding mechanism 53 of the cap unit 50 is omitted in FIG. 2.

The cap unit 50 is disposed above the conveyance unit 30 and configured to be movable up and down along with the conveyance unit 30 by the lifting and lowering device 40. Accordingly, it is possible for the cap unit 50 to attach and detach the cap 51 with respect to the recording head 22.

As shown in FIG. 3, the cap 51 is arranged for each one of colors (4 colors) along the conveyance direction P (X). In addition, three caps 51 are arranged at three positions corresponding to three recording heads 22 arranged in a staggered manner in the paper width direction Y. Accordingly, three caps 51 are arranged for each color, and so twelve caps 51 are arranged in total.

One cap lower part support 61 is arranged downward corresponding to three caps 51 of each color. Four cap lower part supports 61 are integrally configured to compose a receiving unit 60. The cap base member 52 supports the cap 51 and the receiving unit 60.

The sliding mechanism 53 extends to a rear side from where the recording unit 20 and the conveyance unit 30 are disposed, in the paper width direction Y that is orthogonal to the conveyance direction P, as shown in FIG. 3. The sliding mechanism 53 is provided with two endless carriage belts 54 arranged at an interval in the conveyance direction P.

The carriage belts 54 support the cap base member 52, which straddles the two carriage belts 54. Accordingly, the sliding mechanism 53 is configured to cause the cap base member 52 to be slidable between a loading position (shown by a dashed-two-dotted line) immediately below the recording unit 20 and an evacuated position located on the rear side of an installation position of the recording unit 20, as shown in FIG. 3. In other words, the sliding mechanism 53 allows the cap 51 to be located at two positions with respect to the recording head 22, the loading position below the recording head 22 and the evacuated position on the rear side of the recording unit 20.

The cap 51 is attached to the recording head 22 by the sliding mechanism 53. An operation related to the cap attachment is described below.

When the inkjet recording apparatus 1 attaches the cap 51 to each recording head 22, the inkjet recording apparatus 1 causes the lifting and lowering device 40 (see FIG. 1) to lower the conveyance unit 30 from a normal position of printing as shown by virtual lines in FIG. 2. As a result, a gap is generated between the recording unit 20 provided with the recording head 22 and the conveyance unit 30.

Thereafter, the inkjet recording apparatus 1 causes the sliding mechanism 53 to insert the cap base member 52 into the gap generated between the recording head 22 of the recording unit 20 and the conveyance unit 30. Subsequently, the inkjet recording apparatus 1 places the cap base member 52 below the recording head 22 and causes the vertical driving mechanism (not illustrated) to lift the cap base member 52. Accordingly, the inkjet recording apparatus 1 causes the cap 51 to come into contact with and be attached to the nozzle face 221 located on the bottom face of the recording head 22. As the vertical driving mechanism, it may be possible to adopt a mechanism that drives simultaneously cams and the like arranged at four corners of the cap base member 52.

Figure 4:
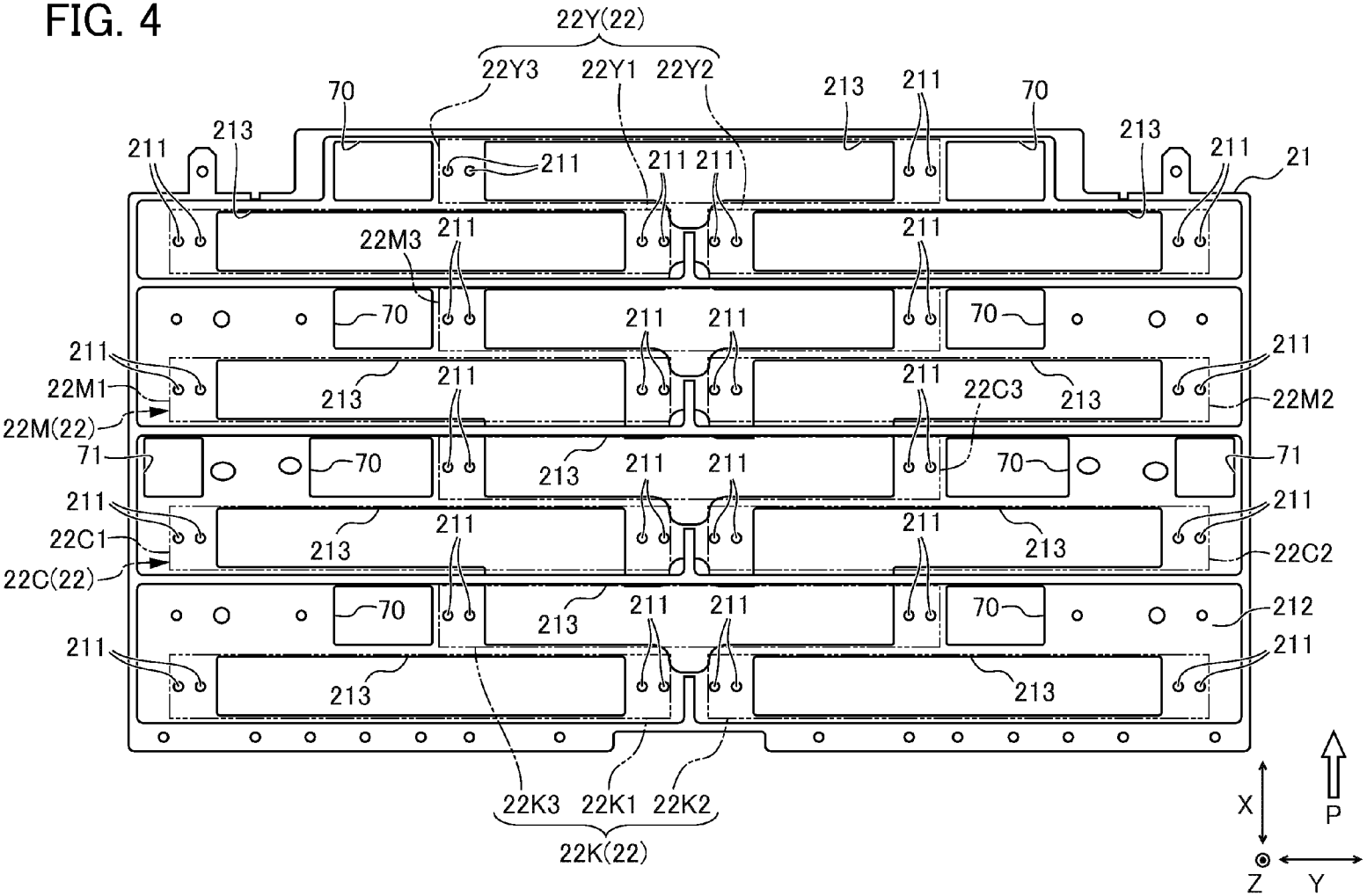
FIG. 4 is a plan view illustrating a configuration of a head frame 21 of the recording unit 20 in the inkjet recording apparatus 1 according to the first embodiment.

Next, the linear recording head 22, the head frame 21 and the like in the inkjet recording apparatus 1 according to the first embodiment are described in detail with reference to FIG. 4. FIG. 4 is a plan view illustrating a configuration of the head frame 21 of the recording unit 20 in the inkjet recording apparatus 1 according to the first embodiment. In FIG. 4, the linear recording heads 22K, 22C, 22M and 22Y are shown by dashed-two-dotted lines.

As shown in FIG. 4, in the linear recording heads 22K, 22C, 22M and 22Y of four colors, three recording heads per color are arranged in a staggered manner along the paper width direction Y. Three recording heads per color include: 22K1, 22K2 and 22K3; 22C1, 22C2 and 22C3; 22M1, 22M2 and 22M3; and 22Y1, 22Y2 and 22Y3.

More specifically, in each of the linear recording heads 22K, 22C, 22M and 22Y, two recording heads are arranged linearly along the paper width direction Y and upstream of the conveyance direction P, namely, two recording heads 22K1 and 22K2, two recording heads 22C1 and 22C2, two recording heads 22M1 and 22M2, and two recording heads 22Y1 and 22Y2. In addition, a recording head 22K3, recording head 22C3, recording head 22M3, and recording head 22Y3 are arranged at a central part in the paper width direction Y and downstream of the conveyance direction P. Groups of three recording heads: 22K1, 22K2 and 22K3; 22C1, 22C2 and 22C3; 22M1, 22M2 and 22M3; and 22Y1, 22Y2 and 22Y3 compose the linear recording heads of four colors (four groups) 22K, 22C, 22M and 22Y, respectively.

As shown in FIG. 4, the head frame 21 includes twelve nozzle openings 213 and attachment holes (attachment portions) 211 corresponding to the nozzle openings 213.

The nozzle openings 213 are each shaped like a rectangular having longer sides in the paper width direction Y, through which the nozzle face 221 of the recording head 22 is exposed downward with respect to the head frame 21. The twelve nozzle openings 213 are grouped into four groups each including three, and are arranged in a staggered manner in each group. The twelve nozzle openings 213 are provided at respective positions corresponding to four groups each including three recording heads arranged in a staggered manner: 22K1, 22K2 and 22K3; 22C1, 22C2 and 22C3; 22M1, 22M2 and 22M3; and 22Y1, 22Y2 and 22Y3. When the recording head 22 is attached to the head frame 21, the nozzle opening 213 is occupied by the recording head 22.

The attachment holes 211 are located spaced apart in the paper width direction Y from each of the end portions of a longitudinal direction (paper width direction Y) of the nozzle openings 213. Each attachment hole 211 is a screw hole for fixing the recording head 22 placed in the nozzle opening 213 to the head frame 21.

As shown in FIG. 4, twelve recording heads 22 are attached to the head frame 21 in a manner described below. The linear recording heads 22K, 22C, 22M and 22Y of four colors are each composed of three recording heads arranged in a staggered manner: 22K1, 22K2 and 22K3; 22C1, 22C2 and 22C3; 22M1, 22M2 and 22M3; and 22Y1, 22Y2 and 22Y3. The linear recording heads 22K, 22C, 22M and 22Y of four colors are placed in the corresponding nozzle openings 213 in this order along the conveyance direction P of the conveyor belt 31 from upstream to downstream. Each of both end portions in the paper width direction Y of each recording head 22 is fastened by a screw engaged with each attachment hole 211 (not illustrated). In this manner, the linear recording heads 22K, 22C, 22M and 22Y of four colors are fixed to the head frame 21.

The head frame 21 is formed of the same material as the recording head 22, for example SUS, so as to prevent a difference in a coefficient of thermal expansion between the head frame 12 and the linear recording heads 22K, 22C, 22M and 22Y of four colors.

As shown in FIGS. 3 and 4, the head frame 21 is configured to be like a rectangular plate when seen in plan view, and to have a size that covers an entirety of the placement face 31A in the paper width direction Y. A width W1 of the head frame 21 in the paper width direction Y is greater than a width W2 of the placement face 31A of the conveyor belt 31 in the paper width direction Y.

The plate-like head frame 21 has ventilation openings (air holes) 70, 71 that penetrate in the thickness direction (vertical direction Z) at the plate-like part 212 except for the attachment holes 211 of the linear recording heads 22K, 22C, 22M and 22Y of four colors.

As shown in FIG. 4, the ventilation openings 70 of eight in total are provided downstream of two of three recording heads with respect to each of the linear recording heads 22K, 22C, 22M and 22Y of four colors. More specifically, two ventilation openings 70 are provided downstream of two recording heads 22K1 and 22K2 arranged most upstream in the conveyance direction P among three recording heads 22K1, 22K2 and 22K3. Two ventilation openings 70 are provided downstream of two recording heads 22C1 and 22C2 among three recording heads 22C1, 22C2 and 22C3. Two ventilation openings 70 are provided downstream of two recording heads 22M1 and 22M2 among three recording heads 22M1, 22M2 and 22M3. Two ventilation openings 70 are provided downstream of two recording heads 22Y1 and 22Y2 arranged most downstream in the conveyance direction P among three recording heads 22Y1, 22Y2 and 22Y3.

In other words, the ventilation openings 70 may be provided for the linear recording heads 22K and 22Y among the linear recording heads 22K, 22C, 22M and 22Y of four colors as described below. The ventilation openings 70 may be provided between two recording heads 22K1 and 22K2 of the linear recording head 22K arranged most upstream in the conveyance direction P and two recording heads 22C1 and 22C2 of the (second) linear recording head 22C arranged downstream adjacent to the linear recording head 22K in the conveyance direction P. Similarly, the ventilation openings 70 may be provided between two recording heads 22Y1 and 22Y2 of the linear recording head 22Y arranged most downstream in the conveyance direction P and two recording heads 22M1 and 22M2 in the (second) linear recording head 22M arranged upstream adjacent to the linear recording head 22Y in the conveyance direction P.

Alternatively, it may be possible to provide the ventilation openings 70 at only one of the following: between the linear recording head 22K arranged most upstream in the conveyance direction P and the second linear recording head 22C; and between the linear recording head 22Y arranged most downstream in the conveyance direction P and the second linear recording head 22M.

The eight ventilation openings 70 may be provided outside both ends of the recording heads 22K3, 22C3, 22M3 and 22Y3 in the paper width direction Y. These recording heads 22K3, 22C3, 22M3 and 22Y3 are arranged in a central part in the paper width direction Y and downstream in the conveyance direction P among three recording heads 22K1, 22K2 and 22K3, three recording heads 22C1, 22C2 and 22C3, three recording heads 22M1, 22M2 and 22M3, and three recording heads 22Y1, 22Y2 and 22Y3, respectively, in the linear recording heads 22K, 22C, 22M and 22Y of four colors.

In addition, as shown in FIG. 4, two ventilation openings 71 are provided in the plate-like part 212 of the head frame 21 except for where the linear recording heads 22K, 22C, 22M and 22Y are attached, outside both ends of the linear recording head 22C for cyan in the paper width direction Y. More specifically, two ventilation openings 71 are provided more outside than the ventilation openings 70, which are positioned outside both ends of the recording heads 22C3 positioned in a central part in the paper width direction Y and downstream in the conveyance direction P, among three recording heads 22C1, 22C2 and 22C3 of the linear recording head 22C for cyan.

The ventilation openings 70 and 71 are provided right and left, symmetrically across the central part in the paper width direction Y of the head frame 21.

A total aperture area S of the eight ventilation openings 70 and two ventilation openings 71 with respect to a flow rate U of the downward airflow generated by the suction unit 36 may be set to be: S [$m^2$]≥U [$m^3$/sec]/5 [m/sec].

In addition, a ratio S:S1 of the total aperture area S of the ventilation openings 70 and 71 with respect to an area S1 of the head frame 21 may be set to be within a range of no less than 1:5 to no greater than 1:20.

An area of each of the ventilation openings 70 and 71 is, for example, no less than $0.5\times10^{-3}$ and no greater than $1.2\times10^{-3}$ [$m^2$].

Figure 5:
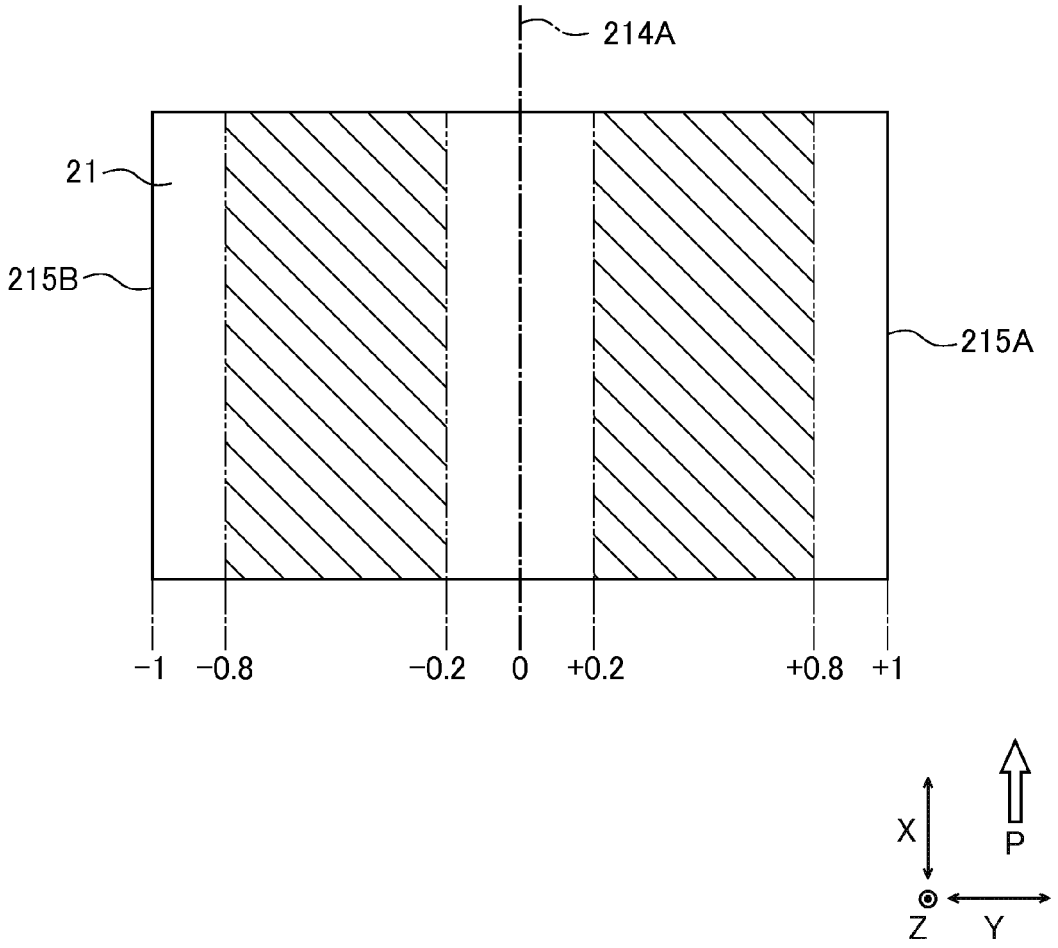
FIG. 5 is a schematic view illustrating a preferred range of a position of a ventilation opening for a case where a contour of the head frame 21 is normalized with respect to a paper width direction Y.
Figure 6:
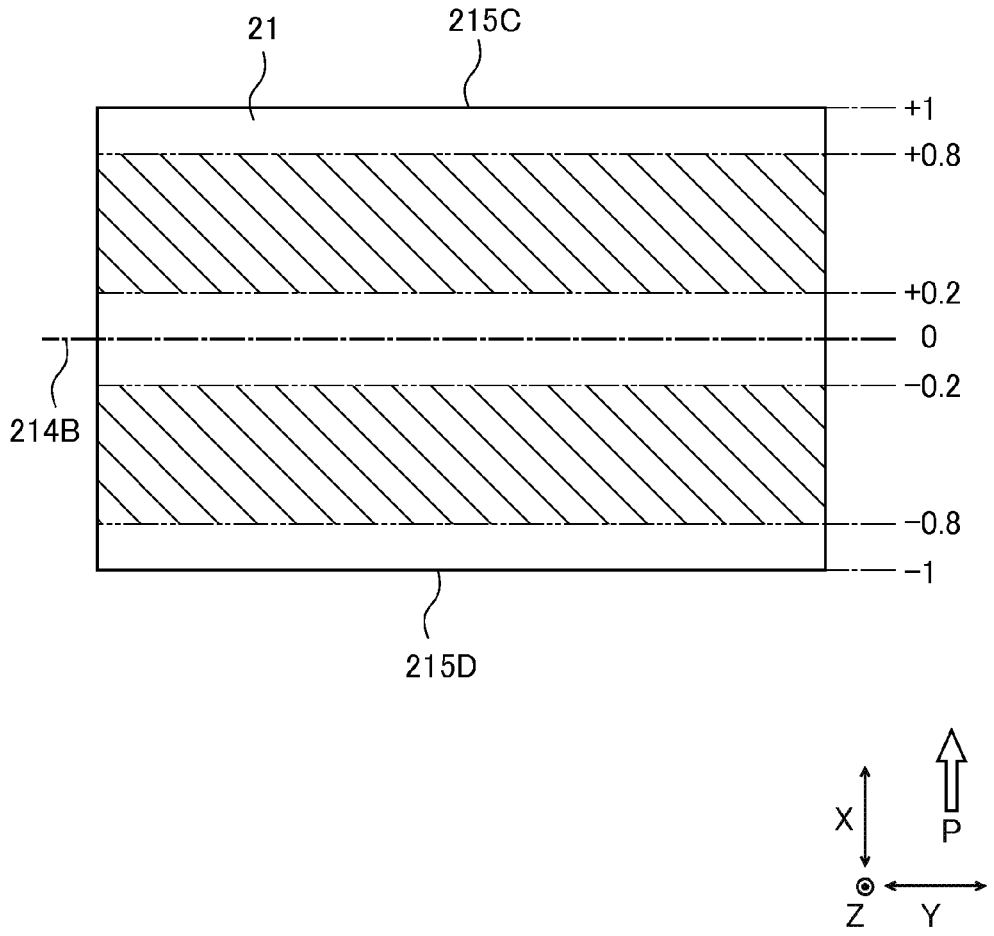
FIG. 6 is a schematic view illustrating a preferred range of a position of the ventilation opening for a case where a contour of the head frame 21 is normalized with respect to a conveyance direction P.

For a case where a contour of the head frame 21 is normalized, the position of a ventilation opening may be preferably but not necessarily within the following range. FIG. 5 is a schematic view illustrating an appropriate range of the position of the ventilation opening for a case where the contour of the head frame 21 is normalized with respect to the paper width direction Y. FIG. 6 is a schematic view illustrating an appropriate range of the position of the ventilation opening for a case where the contour of the head frame 21 is normalized with respect to the conveyance direction P.

First, a case is described in which the contour of the head frame 21 is normalized with respect to the paper width direction Y as shown in FIG. 5 such that a first end 215A is defined as +1 and a second end 215B is defined as −1. The normalization of the contour of the head frame 21 is performed through, for example, approximating the contour of the head frame 21 as a rectangle having sides extending in the conveyance direction P and the paper width direction Y. With the rectangular contour of the head frame 21, a central position in the paper width direction Y is defined as "0" (a dashed-dotted line 214A in FIG. 5 indicating a straight line that runs through the position of "0" and is parallel to the conveyance direction P). The first end 215A of the contour is defined as "+1" and the second end 215B of the contour is defined as "−1". In a case of such normalization, the position of the ventilation opening may be preferably but not necessarily within at least any one of: a range of no less than −0.8 and no greater than −0.2 in the paper width direction Y; and a range of no less than +0.2 and no greater than +0.8 in the paper width direction Y (areas marked by hatching in FIG. 5).

Next, a case is described in which the contour of the head frame 21 is normalized with respect to the conveyance direction P as shown in FIG. 6 such that a first end 215C of the contour is defined as +1 and a second end 215D of the contour is defined as −1. The normalization of the contour of the head frame 21 is performed through, for example, approximating the contour of the head frame 21 as a rectangle having sides extending in the conveyance direction P and the paper width direction Y. With the rectangular contour of the head frame 21, a central position in the conveyance direction P is defined as "0" (a dashed-dotted line 214B in FIG. 6 indicating a straight line that runs through the position of "0" and is parallel to the paper width direction Y). The first end 215C of the contour is defined as "+1" and the second end 215D of the contour is defined as "−1". In a case of such normalization, the position of the ventilation opening may be preferably but not necessarily within at least any one of: a range of no less than −0.8 and no greater than −0.2 in the conveyance direction P; and a range of no less than +0.2 and no greater than +0.8 in the conveyance direction P (areas marked by hatching in FIG. 6).

It should be noted that the ventilation openings 70 and 71 do not include holes that are occupied or do not substantially function for ventilation during use of the inkjet recording apparatus 1, such as screw holes (attachment holes 211) and through holes for attaching components other than the linear recording heads 22K, 22C, 22M and 22Y of four colors to the head frame 21.

Hereinafter, an operation of recording images and the like by the inkjet recording apparatus 1 according to the first embodiment is described briefly.

A sheet of paper T as the recording medium is introduced from one side in the conveyance direction P and placed on the placement face 31A of the conveyor belt 31. A suction force exerted by downward airflow occurs at the placement face 31A. This downward airflow is applied by operation of the suction unit 36 to the conveyor belt 31 via through holes for suction (not illustrated) at the upper face of the conveyor belt 31 and the suction unit 36. The sheet of paper T placed on the placement face 31A of the conveyor belt 31 is conveyed toward the other side in the conveyance direction P, while the sheet of paper T is sucked to the conveyance face 31A by the suction force exerted by the downward airflow.

Inks of four colors are sequentially ejected from a nozzle face 221 of an ink ejection nozzle (not illustrated) of each of the linear recording heads 22K, 22C, 22M and 22Y of four colors in the recording unit 20 toward the sheet of paper T, which is conveyed while being sucked to the placement face 31A of the conveyor belt 31. In this manner, an image and the like are recorded (printed) on the sheet of paper T.

The sheet of paper T on which the image and the like have been recorded by the inks of four colors ejected from the recording unit 20 is conveyed to the dryer 7, where the inks are dried. The sheet of paper T which has completed drying of the inks by the dryer 7 is conveyed downstream in the conveyance direction P by the pair of paper discharging rollers 8. The sheet of paper T is further conveyed to the ejected paper tray 10 provided outside the main body 2 via the paper ejection opening 9, thereby discharged from the main body 2.

During recording of the image and the like as described above, the downward airflow generated by operation of the suction unit 36 for sucking the sheet of paper T is applied to the placement face 31A of the conveyor belt 31. The downward airflow is a wind (airflow) moving toward the suction unit 36, which is supplied from a gap between the head frame 21 and the placement face 31A or from the ventilation openings 70 and 71 provided in the plate-like part 212 of the head frame 21 (except for the attachment holes 211 for the linear recording heads 22K, 22C, 22M and 22Y). The wind flows in a horizontal direction (planar direction of the head frame 21 and the placement face 31A).

Figure 7:
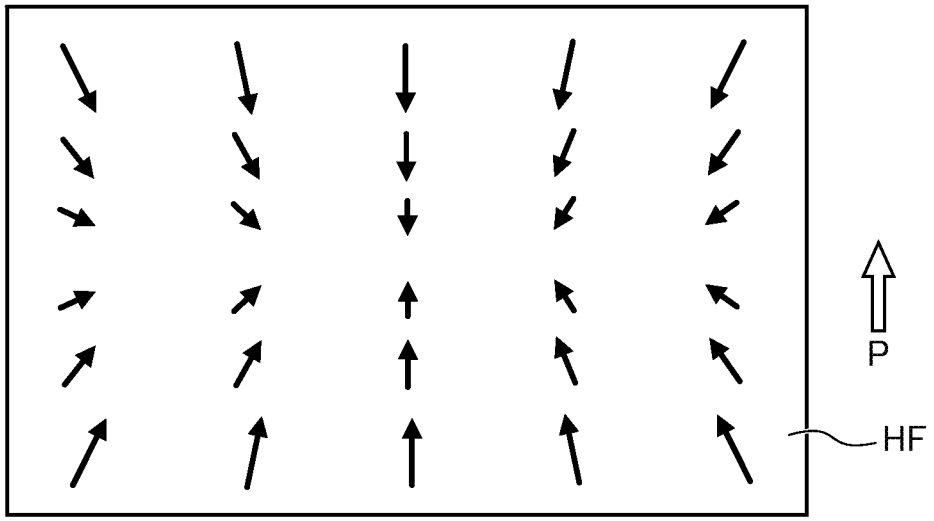
FIG. 7 is a diagram illustrating a distribution of wind directions and wind speeds of horizontal wind generated in a gap between the head frame 21 and a placement face 31A of a conveyor belt 31.

The flow rate (wind speed) of the horizontal wind increases as the gap between the plate-like head frame 21 and the placement face 31A of the conveyor belt 31 decreases. In addition, as shown in FIG. 7, the horizontal wind generated in the gap (shown by arrows in FIG. 7) is directed in plane to a center of a head frame HF. The wind speed increases as the distance in plane from the center increases and decreases as the distance in plane to the center decreases. The wind speed takes the maximum value at the most upstream portion and the most downstream portion in the conveyance direction P of the recording medium. Under condition of the distribution of wind direction and wind speed of the horizontal wind generated in the gap between the head frame and the placement face of the conveyor belt as shown in FIG. 7, the direction of the ink ejected downward from a nozzle of each of the plurality of recording heads and positions of dots formed by droplets of ink attached to the recording medium are susceptible to a disturbance created by the horizontal wind. Especially when the ink ejected from the nozzle generates satellite droplets, which are small in volume, in addition to main droplets, the satellite droplets small in volume are affected more by the horizontal wind. As a result, the positions of ink adhered to the recording medium are greatly disturbed. Accordingly, it is likely that a smudgy image and the like occur due to the displacement of dot positions and the disturbance of images created by the satellite droplets.

According to the present embodiment, the ventilation openings 70 and 71 are provided in the plate-like part 212 of the head frame 21 (except for the attachment holes 211 for the linear recording heads 22K, 22C, 22M and 22Y). As a result, the downward airflow generated by operation of the suction unit 36 is supplied not only from the gap between the head frame 21 and the placement face 31A, but also from the ventilation openings 70 and 71. Accordingly, the wind speed of the horizontal wind having the distribution of wind direction and wind speed as shown in FIG. 7 will decrease. Especially, the speed of the wind having the highest value at the most upstream side and the most downstream side in the conveyance direction P of a sheet of paper T will decrease.

Accordingly, it is possible to prevent the disturbance of the direction of the ink ejected downward from the nozzle face 221 of each of the linear recording heads 22K, 22C, 22M and 22Y under the influence of the horizontal wind. It is possible to cause the droplets of ink to be attached to predetermined positions on the sheet of paper T, thereby preventing the displacement of dots. Furthermore, even in a case in which satellite droplets small in volume are generated, it is possible to prevent a smudgy image from being generated due to the satellite droplets, which are disturbed under the influence of the horizontal wind. As a result, it is possible to obtain a clean image and the like recorded (printed) on the sheet of paper T.

The inkjet recording apparatus 1 of the first embodiment provides, for example, the following effects.

The inkjet recording apparatus 1 of the first embodiment is provided with the plate-like head frame 21 to which the linear recording heads 22K, 22C, 22M and 22Y of four colors are attached. The plate-like head frame 21 has the ventilation openings 70, 71 that penetrate in the thickness direction at the plate-like part 212 except for the attachment holes 211 for installing the linear recording heads 22K, 22C, 22M and 22Y of four colors. According to the first embodiment, the downward airflow (wind) generated by operation of the suction unit 36 is supplied not only from the gap between the head frame 21 and the placement face 31A, but also from the ventilation openings 70 and 71. Accordingly, it is possible to reduce the speed of the wind flowing in the horizontal direction (planar direction of the head frame 21 and the placement face 31A). In this manner, it is possible to reduce the displacement of the dots due to the disturbance of the direction of the ink ejected from the nozzle and the smudgy image generated due to the satellite droplets. As a result, it is possible to record a clean image and the like.

In the first embodiment, the ventilation openings 70 are provided downstream of the linear recording head 22K arranged most upstream in the conveyance direction P, and upstream of the linear recording head 22Y arranged most downstream in the conveyance direction P, among the plurality of linear recording heads 22K, 22C, 22M and 22Y. As shown in FIG. 7, the wind speed is higher in the vicinity of these positions. With the ventilation openings 70 provided at the positions having higher wind speed, it is possible to further increase an effect of reducing the wind speed.

In addition, in the first embodiment, the total aperture area S of the ventilation openings 70 and 71 with respect to the flow rate U of the downward airflow generated by the suction unit 36 may be set to be: S [$m^2$]≥U [$m^3$/sec]/5 [m/sec]. This can maintain a state of reliably sucking a sheet of paper T to the placement face 31A of the conveyor belt 31 by means of a sufficient suction force exerted by the downward airflow. Furthermore, it is possible to reduce the disturbance of the direction of the ejected ink and the smudgy image generated due to satellite droplets. In this manner, it is possible to reliably record a clean image and the like.

In addition, the distribution of wind direction and wind speed of the horizontal wind generated in the gap between the head frame 21 and the placement face 31A of the conveyor belt 31 is as shown in FIG. 7. Especially, the position of the ventilation openings may be configured to fall within the range of no less than −0.8 and no greater than −0.2 in the paper width direction Y or the range of no less than +0.2 and no greater than +0.8 in the paper width direction Y, and/or the range of no less than −0.8 and no greater than −0.2 in the conveyance direction P or the range of no less than +0.2 and no greater than +0.8 in the conveyance direction P. The arrangement of the ventilation openings as described above may achieve the abovementioned effects of the present embodiment (present disclosure).

Next, a second embodiment of the present disclosure is described. The description of the second embodiment will focus mainly on the points of difference from the first embodiment, and those aspects of configuration that are the same as the first embodiment are denoted with the same reference numerals, and detailed description thereof will be omitted. Descriptions in the first embodiment apply to components that are not explained in the second embodiment. In addition, the second embodiment may provide the same effects as the first embodiment.

Second Embodiment

Figure 8:
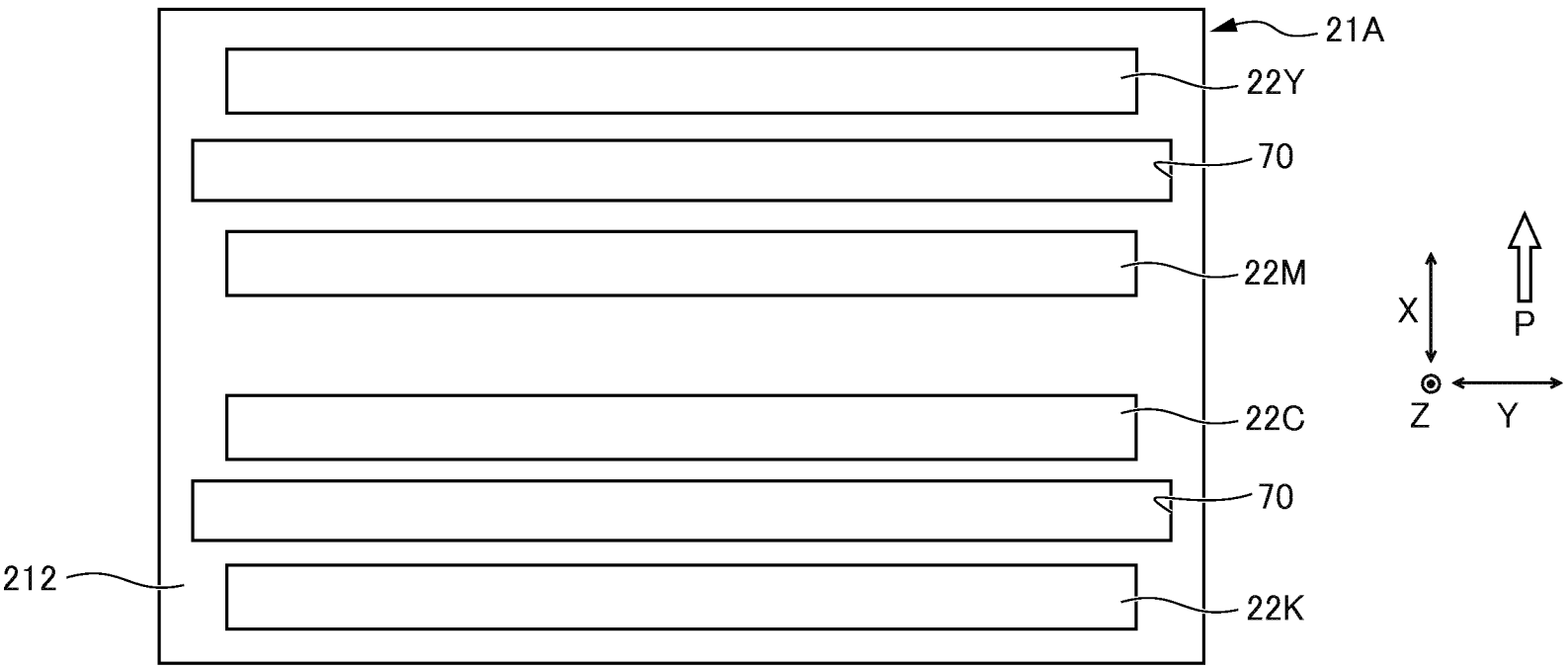
FIG. 8 is a plan view illustrating a configuration of a head frame 21A of a recording unit in an inkjet recording apparatus according to a second embodiment.

The second embodiment is described with reference to FIG. 8. FIG. 8 is a plan view illustrating a configuration of a head frame 21A of a recording unit in an inkjet recording apparatus according to a second embodiment.

In the second embodiment, as shown in FIG. 8, linear recording heads 22K, 22C, 22M and 22Y of four colors are respectively composed of a single recording head extending over a substantially entire width in a paper width direction Y (a substantially entire length in an orthogonal direction). The order of arrangement of the linear recording heads 22K, 22C, 22M and 22Y of four colors in a conveyance direction P is the same as that of the first embodiment.

In the first embodiment, the ventilation openings 70 are provided in the plate-like part 212 at the positions downstream of the recording heads 22K, 22C, 22M and 22Y of each color. On the other hand, in the second embodiment, ventilation openings 70 of two in total are provided at one position of a plate-like part 212 of the head frame 21A between the linear recording head 22K of a first color and the linear recording head 22C of a second color, and at the other position of the plate-like part 212 of the head frame 21A between the linear recording head 22M of a third color and the linear recording head 22Y of a fourth color. The ventilation openings 70 are not provided between the linear recording head 22C of the second color and the linear recording head 22M of the third color at the plate-like part 212 of the head frame 21A.

A length of each of two ventilation openings 70 in the paper width direction Y is equal to or greater than a length of each of the linear recording heads 22K, 22C, 22M and 22Y of four colors. Both ends of each of two ventilation openings 70 either correspond to or are located outward from both ends of each of the linear recording heads 22K, 22C, 22M and 22Y in the paper width direction Y.

In the second embodiment, a total aperture area S of the ventilation openings 70 with respect to a flow rate U of the downward airflow generated by a suction unit 36 is set to be: S [$m^2$]≥U [$m^3$/sec]/5 [m/sec] in the same manner as the first embodiment.

In the second embodiment, one ventilation opening 70 is provided downstream of the linear recording head 22K that is arranged most upstream in the conveyance direction P and upstream of the linear recording head 22Y that is arranged most downstream in the conveyance direction P, respectively, among the plurality of linear recording heads 22K, 22C, 22M and 22Y.

As a result, it is understandable from the distribution characteristics of wind direction and wind speed shown in FIG. 7 that the greatest wind speed on the most upstream side and most downstream side in the conveyance direction P will decrease. Accordingly, it is possible to efficiently reduce the disturbance of the direction of ejected ink and satellite droplets, so that it is possible to reliably record a clear image and the like.

Exemplary embodiments of the present disclosure have been described above. However, the present disclosure is not limited thereto and can be carried out in various modes.

For example, in the first embodiment, the ventilation openings 71 of two in total are provided outside both ends of each of the linear recording heads 22K, 22C, 22M and 22Y in the paper width direction at the plate-like part 212. However, the present disclosure is not limited to this arrangement. Alternatively, the ventilation openings 71 may be omitted.

In addition, in the first embodiment, the ventilation openings 70 of eight in total are provided outside both ends of each of the recording heads 22K3, 22C3, 22M3 and 22Y3 in the paper width direction Y, which are arranged at a central part in the paper width direction Y and downstream in the conveyance direction P, among three recording heads 22K1, 22K2 and 22K3, three recording heads 22C1, 22C2 and 22C3, three recording heads 22M1, 22M2 and 22M3, and three recording heads 22Y1, 22Y2 and 22Y3 in the linear recording heads 22K, 22C, 22M and 22Y of four colors. However, the present invention is not limited to this arrangement. For example, it may alternatively be possible that no ventilation openings are provided outside both ends of the recording head 22C3 located at a central part of the linear recording head 22C, which is arranged at a second position in the conveyance direction P.

EXPERIMENTAL EXAMPLE 1

An experiment on the effect of horizontal wind was performed for an inkjet recording apparatus having a setup described below. Linear recording heads of four colors each have three recording heads which are arranged in a staggered manner. These linear recording heads are attached to a head frame arranged as shown in FIG. 4. Ventilation openings as shown in FIG. 4 are provided at the head frame.

Conditions set for the experiment are described below.

Total area of ventilation openings: S [$mm^2$]=8878 $mm^2$;

Flow rate of downward airflow generated by suction unit: U=2 $m^3$/min;

Gap between a head frame and placement face of conveyor belt: H=1 mm;

Width of the head frame in a paper width direction: W=455 mm; and

Width of the head frame in a conveyance direction: L=240 mm.

Under the above conditions, modeling described below was performed.

An outer perimeter of the head frame was defined as 2 (W+L). Total area along an outer perimeter of a gap between the head frame and the placement face of the conveyor belt was defined as 2 (W+L) H.

In such configuration, a wind speed V [m/sec] of a horizontal wind generated in the gap between the head frame provided with the ventilation openings and the placement face of the conveyor belt is calculated to be:

$$V=U/\{2(W+L)H+S\}=3.2 \text{ [m/sec]}.$$

Figure 9:
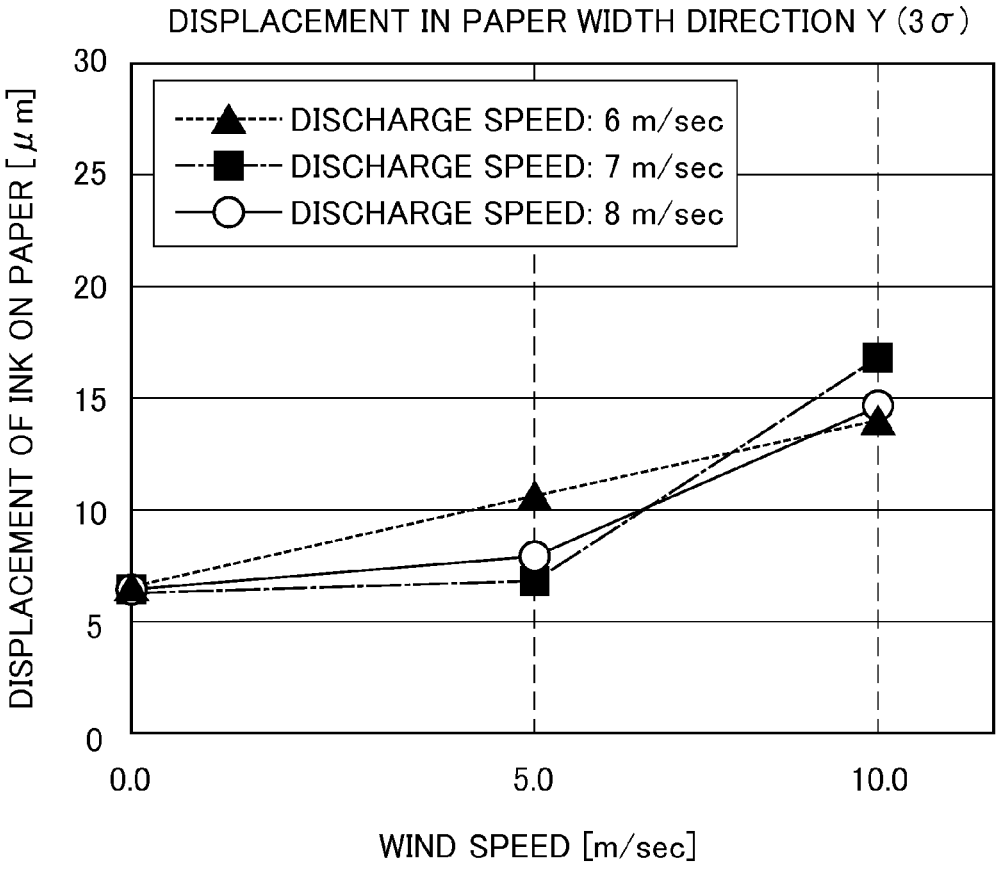
FIG. 9 is a graph showing a result of an experiment on the displacement of ink adhered to a sheet of paper in the paper width direction Y due to a horizontal wind.
Figure 10:
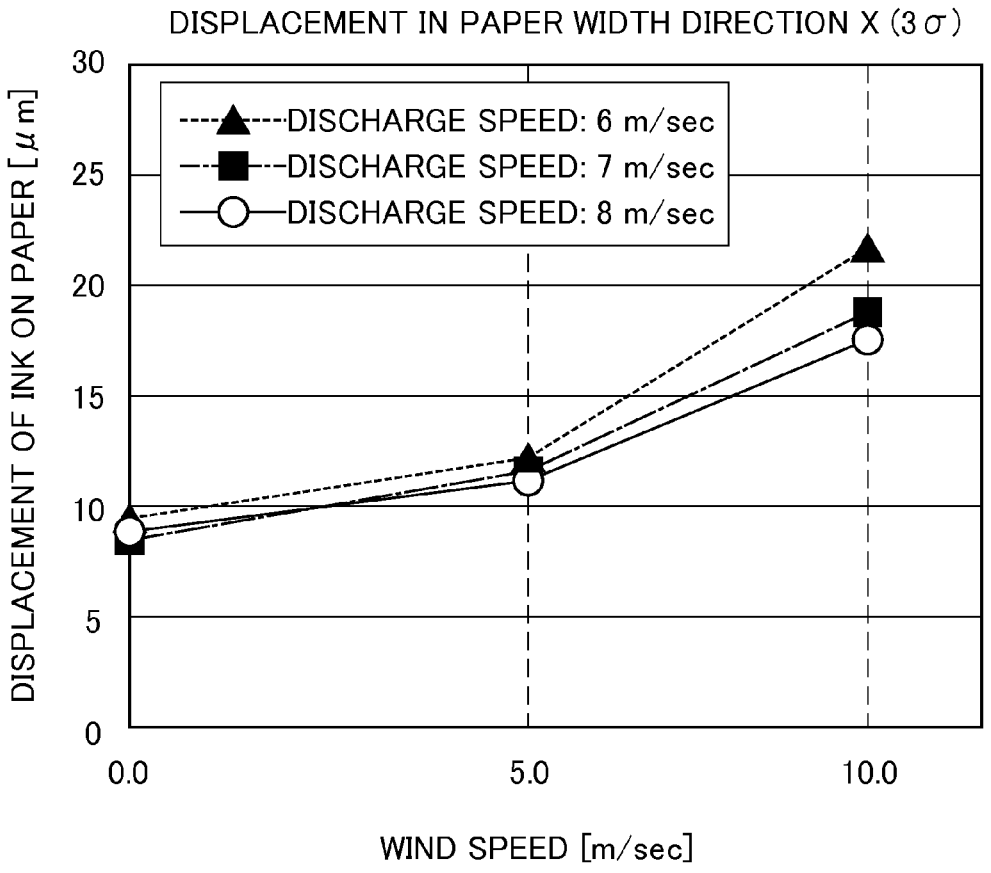
FIG. 10 is a graph showing a result of an experiment on the displacement of ink adhered to a sheet of paper in the conveyance direction P due to a horizontal wind.

A simple experiment on the displacement of ink adhered to a sheet of paper under influence of the horizontal wind was carried out under the above conditions. The wind speed V of the horizontal wind was changed to three values, 0.0 m/sec, 5.0 m/sec, and 10.0 m/sec. The experiment provided results shown in FIGS. 9 and 10. FIG. 9 is a graph showing a result of an experiment on the displacement of ink adhered to a sheet of paper in the paper width direction Y due to the horizontal wind. FIG. 10 is a graph showing a result of an experiment on the displacement of ink adhered to a sheet of paper in the conveyance direction P due to the horizontal wind. The results shown in FIGS. 9 and 10 demonstrate that it is possible to prevent the displacement of ink adhered to a sheet of paper if the wind speed V of the horizontal wind is no greater than 5 m/sec. Since the wind speed V in an actual apparatus is calculated to be 3.2 [m/sec] as described above, it is possible to prevent the displacement of ink adhered to a sheet of paper also in the actual apparatus.

Furthermore, since the S is determined to satisfy a relationship, 2 (W+L) H<<S when the ventilation openings are provided at the head frame, it is possible to perform an approximation, V≈U/S. In addition, it is seen from the above experimental results that the relationship V≤5 m/sec may be preferable for preventing the displacement of position of ink adhered to a sheet of paper. Therefore, the experiment demonstrated that a relationship between the aperture area S of the ventilation openings with respect to the flow rate U of the downward airflow generated by the suction unit is set to satisfy: S [$m^2$]≥U [$m^3$/sec]/5 [m/sec].

EXPERIMENTAL EXAMPLE 2

Figure 11A:
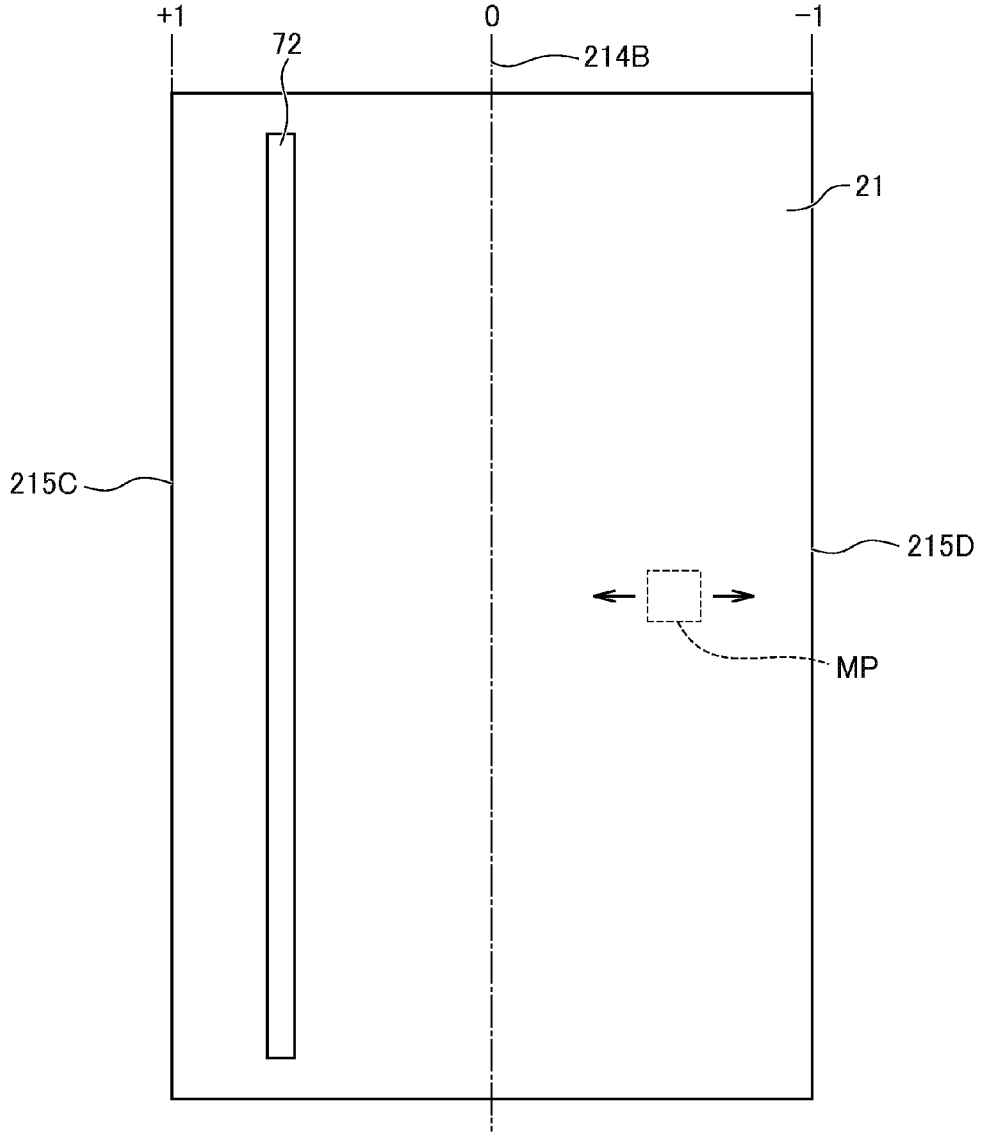
FIG. 11A is a plan view of the head frame 21, illustrating a method of an experiment for determining an appropriate range of a position of a slit-like ventilation opening 72 with normalization of a contour of the head frame 21.
Figure 11B:
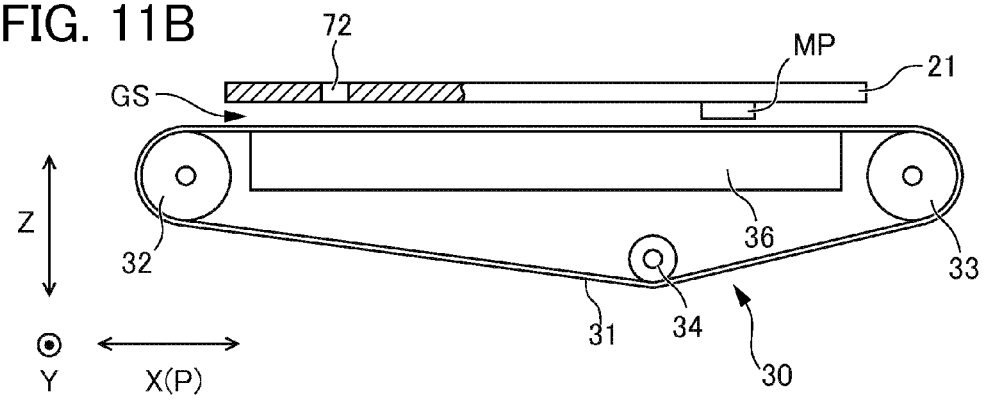
FIG. 11B corresponding to FIG. 11A is a front view illustrating the head frame 21 and the conveyance unit 30.
Figure 12:
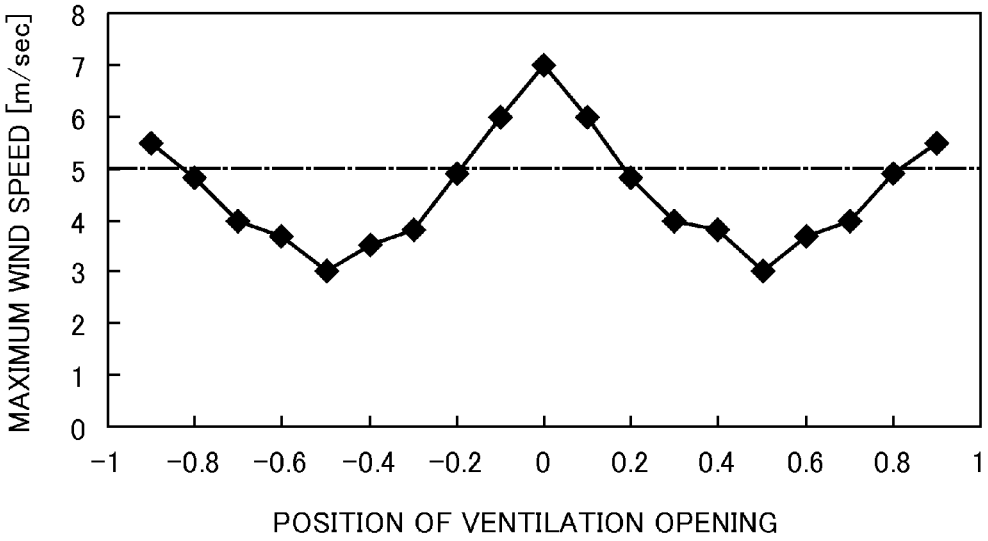
FIG. 12 is a graph showing experimental data of a relationship between the position of the ventilation opening and maximum wind speed, when a contour of the head frame 21 is normalized.

An experiment was carried out for determining a preferred range of a position of slit-like ventilation opening 72 for a case where the contour of a head frame 21 was normalized with respect to a conveyance direction P. FIG. 11A is a plan view of the head frame 21 illustrating an experiment for determining a preferred range of a position of a slit-like ventilation opening 72 for a case where the contour of the head frame 21 is normalized. FIG. 11B corresponding to FIG. 11A is a front view illustrating the head frame 21 and a conveyance unit 30. FIG. 12 is a graph showing experimental data of a relationship between the position of the ventilation opening and maximum wind speed for a case where the contour of the head frame 21 is normalized.

Conditions set for the experiment are described below (see FIGS. 11A and 11B).

Flow rate of a downward airflow generated by a suction unit 36: U=2 $m^3$/min;

Gap GS between the head frame 21 and a placement face 31A of a conveyor belt 31: H=1 mm;

Width of the head frame 21 in a paper width direction Y: W=455 mm;

Width of the head frame 21 in a conveyance direction P: L=240 mm;

Under the above conditions, modeling was performed as described below.

Width of a slit-like ventilation opening 72 (length along the conveyance direction P)=12 mm;

Length of the slit-like ventilation opening 72 (length along the paper width direction Y)=430 mm;

Anemometer: air speed transducer 6332D and air speed measuring probe MP 3239 manufactured by KANOMAX JAPAN INCORPORATED.

Head frames 21 were prepared in each of which a normalized position of a slit-like ventilation opening 72 was changed by 0.1 over a range of −0.9 to +0.9 in the conveyance direction P.

The wind speed measuring probe MP was placed in the gap GS at a central position of a head frame 21 in the paper width direction Y (on a straight line which was parallel to the conveyance direction P and divided the head frame 21 into two equal parts in the paper width direction Y). The suction unit 36 was turned on so that a suction force exerted by the downward airflow was generated. In this manner, a wind (airflow) flowing in a horizontal direction (an in-plane direction of the head frame 21 and the placement face 31A) toward the suction unit 36 was generated, which was supplied from the gap GS between the head frame 21 and the placement face 31A or from the ventilation openings 72.

The wind speed measuring probe MP was moved (scanned) in parallel with the conveyance direction P at the central position in the paper width direction Y of the head frame 21. Wind speed was measured in various locations and the maximum wind speed was determined. In this manner, the maximum wind speed was measured for each head frame 21 in which the normalized position of the slit-like ventilation opening 72 was changed by 0.1 over the range of −0.9 to +0.9 in the conveyance direction P. An experimental result is shown in FIG. 12, which is measured data of a relationship between the position of the ventilation opening and maximum wind speed.

FIG. 12 demonstrates that the maximum wind speed is adjusted no greater than 5 m/sec if the normalized position of the slit-like ventilation opening 72 is within a range of no less than −0.8 and no greater than −0.2, and a range of no less than +0.2 and no greater than +0.8 in the conveyance direction P. As described above, if the maximum wind speed is no greater than 5 m/sec, it may be possible to prevent the displacement of ink adhered to a sheet of paper. Accordingly, it may be preferable that the normalized position of the slit-like ventilation opening 72 is within the range of no less than −0.8 and no greater than −0.2, and the range of no less than +0.2 and no greater than +0.8 in the conveyance direction P.

Experimental Example 2 is an example of determining the preferred range of the position of the slit-like ventilation opening 72 for a case where the contour of the head frame 21 is normalized with respect to the conveyance direction P. The result of Experimental Example 2 may apply to an experimental example of determining a preferred range of a position of the slit-like ventilation opening 72 for a case where the contour of the head frame 21 is normalized with respect to the paper width direction Y.

The invention claimed is:

1. An inkjet recording apparatus comprising:

a conveyor belt having a placement face on which a recording medium is placed and conveyed, the conveyor belt configured to cause the placement face to move in a conveyance direction of conveying the recording medium;

a suction unit that is disposed below the placement face of the conveyor belt configured to apply a suction force exerted by a downward airflow to the recording medium placed on the placement face, such that the recording medium is sucked onto the placement face;

a plurality of linear recording heads arranged in the conveyance direction, which is disposed upward opposite to the suction unit across the conveyor belt, has a nozzle face on which an ink ejection nozzle is formed and extends in an orthogonal direction orthogonal to the conveyance direction; and a head frame shaped like a plate, to which the plurality of linear recording heads is attached, having a plurality of ventilation openings penetrating in a thickness direction at a portion like a plate except for where the plurality of linear recording heads is attached, wherein a total aperture area S of the plurality of ventilation openings is set to satisfy: $2(W+L)H \ll S$, where W represents a width of the head frame in the orthogonal direction, L represents a length of the head frame in the conveyance direction and H represents a gap between the head frame and the placement face of the conveyor belt, respectively, wherein a velocity V of a horizontal wind generated in a gap between the head frame and the placement face of the conveyer belt is approximated by a relation of $V \approx U/S$, where U represents a flow rate of a downward airflow generated by the suction unit, wherein the total aperture area S is configured to allow the velocity V to be no greater than 5 m/sec with respect to the given flow rate U, and wherein when one end of the head frame is normalized as 1 and the other end of the head frame is normalized as −1 in the conveyance direction, the plurality of ventilation openings constituting the total aperture area S lie exclusively within a range between no less than −0.8 and no greater than −0.2; or within a range between no less than +0.2 and no greater than +0.8.

2. The inkjet recording apparatus according to claim 1, wherein the plurality of ventilation opening comprises a first ventilation opening which is provided at least any one of: at a position downstream with respect to a linear recording head disposed most upstream in the conveyance direction; and at a position upstream with respect to a linear recording head disposed most downstream in the conveyance direction, among the plurality of linear recording heads.

3. The inkjet recording apparatus according to claim 2, wherein the first ventilation opening is provided at least any one of: between the linear recording head disposed most upstream in the conveyance direction and a linear recording head downstream adjacent thereto; and between the linear recording head disposed most downstream in the conveyance direction and a linear recording head upstream adjacent thereto.

4. The inkjet recording apparatus according to claim 1, wherein the plurality of ventilation openings comprises a second ventilation opening which is provided at least any one of: at a position upstream of a linear recording head disposed most upstream in the conveyance direction; and at a position downstream of a linear recording head disposed most downstream in the conveyance direction, among the plurality of linear recording heads.

5. The inkjet recording apparatus according to claim 1, wherein each of the linear recording heads comprises a plurality of recording heads arranged in the orthogonal direction.

6. The inkjet recording apparatus according to claim 5, wherein the plurality of ventilation openings is provided between one recording head of one color and another recording head of another color adjacent to the one recording head in the conveyance direction, among the plurality of recording heads.

7. The inkjet recording apparatus according to claim 1, wherein when one end of the head frame is normalized as 1 and the other end of the head frame is normalized as −1 in the orthogonal direction, the plurality of ventilation openings constituting total aperture area S lie exclusively within a range between no less than −0.8 and no greater than −0.2; or within a range between no less than +0.2 and no greater than +0.8.

* * * * *